US006769835B2

(12) United States Patent
Stridsman

(10) Patent No.: US 6,769,835 B2
(45) Date of Patent: Aug. 3, 2004

(54) FLOOR BOARD WITH COUPLING MEANS

(75) Inventor: Per-Eric Stridsman, Hanaskog (SE)

(73) Assignee: Tarkett Sommer AB, Hanaskog (SE)

( * ) Notice: Subject to any disclaimer, the term of this patent is extended or adjusted under 35 U.S.C. 154(b) by 0 days.

(21) Appl. No.: 10/311,926

(22) PCT Filed: Jun. 14, 2001

(86) PCT No.: PCT/SE01/01343

§ 371 (c)(1),
(2), (4) Date: May 27, 2003

(87) PCT Pub. No.: WO01/98604

PCT Pub. Date: Dec. 27, 2001

(65) Prior Publication Data

US 2003/0180091 A1 Sep. 25, 2003

(30) Foreign Application Priority Data

Jun. 22, 2000 (SE) ..... 0002342

(51) Int. Cl.[7] ..... E04F 15/04
(52) U.S. Cl. ..... 404/41; 52/392; 52/589.1
(58) Field of Search ..... 404/34, 35, 40, 404/41; 52/589.1, 592.1, 390, 392, 592.4, 591.1

(56) References Cited

U.S. PATENT DOCUMENTS

| | | | | |
|---|---|---|---|---|
| 3,859,000 A | | 1/1975 | Webster | |
| 6,006,486 A | * | 12/1999 | Moriau et al. | 52/589.1 |
| 6,209,278 B1 | * | 4/2001 | Tychsen | 52/592.4 |
| 6,385,936 B1 | * | 5/2002 | Schneider | 52/589.1 |
| 6,536,178 B1 | * | 3/2003 | P.ang.lsson et al. | 52/392 |
| 6,584,747 B2 | * | 7/2003 | Kettler et al. | 52/592.2 |
| 6,601,359 B2 | * | 8/2003 | Olofsson | 52/588.1 |
| 2002/0056245 A1 | * | 5/2002 | Thiers | 52/589.1 |
| 2002/0189183 A1 | * | 12/2002 | Ricciardelli | 52/390 |
| 2003/0029117 A1 | * | 2/2003 | Moriau et al. | 52/592.1 |
| 2003/0041545 A1 | * | 3/2003 | Stanchfield | 52/592.1 |
| 2003/0084636 A1 | * | 5/2003 | Pervan | 52/592.1 |
| 2003/0154681 A1 | * | 8/2003 | Pletzer et al. | 52/578 |
| 2003/0188504 A1 | * | 10/2003 | Ralf | 52/578 |

FOREIGN PATENT DOCUMENTS

| | | | | |
|---|---|---|---|---|
| DE | 33 43 601 | | 6/1985 | |
| DE | 10013684 A1 | * | 10/2001 | E04F/15/02 |
| JP | 09165844 A | * | 6/1997 | E04B/1/94 |
| JP | 09177201 A | * | 7/1997 | E04B/1/94 |
| JP | 09189116 A | * | 7/1997 | E04F/13/18 |
| WO | WO96/27719 | | 9/1996 | |
| WO | WO 3016656 A1 | * | 2/2003 | E04F/15/04 |

* cited by examiner

*Primary Examiner*—Thomas B. Will
*Assistant Examiner*—Alexandra K. Pechhold
(74) *Attorney, Agent, or Firm*—Finnegan, Henderson, Farabow, Garrett & Dunner, LLP

(57) ABSTRACT

A floor board is arranged to be connectable to other similar boards to form a floor. The floor board includes a first female coupler extending along a first edge of the board, wherein the first female coupler comprises a first coupling element having a groove and a surface extending obliquely from the groove and away from a wall of the groove so as to form a stop. The floor board also includes a first male coupler extending along a second edge of the board, wherein the first male coupler comprises a second coupling element having a V shape portion and a portion disposed in a recess formed in the board, wherein an outer V-leg of the second coupling element is deformable in the direction of an Inner V-leg, and wherein the second coupling element in its non-deformed state is complementary to the shape of the groove of the first coupling element.

9 Claims, 3 Drawing Sheets

FLOOR BOARD WITH COUPLING MEANS

This application is a national stage filing under 35 U.S.C. §371 of International Application No. PCT/SE01/01343, filed on Jun. 14, 2001, which published in the English language. This application also claims the benefit of priority under 35 U.S.C. § 119(a) to SE Patent Application No. 0002342-4, filed on Jun. 22, 2000.

FIELD OF THE INVENTION

The present invention relates to a floor board of elongated rectangular shape, which comprises coupling means at its lateral edges and which is arranged to be connected to other similar floor boards to form a floor, which is made up of a plurality of adjacent, parallel rows of juxtaposed floor boards and in which the floor boards of one and the same row are interconnected short side to short side and the floor boards of adjacent rows are interconnected long side to long side, the coupling means being composed of a first pair of coupling means consisting of a female coupling means and a male coupling means, which extend along the one and the other long side edges of the floor board, respectively, and a second pair of coupling means consisting of a female coupling means and a male coupling means, which extend along the one and the other short sides of the floor board, respectively.

BACKGROUND ART

In common, prior-art floor boards of this type, the female coupling means consist of grooves and the male coupling means of tongues (or feathers). A laterally open groove is formed in one of the long side faces of the floor board, and a laterally open groove is formed in one of its short side faces, the two grooves extending along the board's entire length and width, respectively. A laterally projecting tongue is formed on the other long side face of the floor board, and a laterally projecting tongue is formed on its other short side face, the two tongues extending substantially along the board's entire length and width, respectively. These floor boards are intended to be interconnected so as to form a floor. For this purpose, the tongues of a floor board are inserted horizontally into a long side groove of another floor board and into a short side groove of yet another floor board. The dimensions of the grooves and tongues are chosen so that the tongues are insertable into the grooves with a very tight fit. Before the tongues are inserted into the grooves, glue is applied in the grooves. The grooves and tongues provide a relative locking of the interconnected floor boards perpendicularly to the floor level, and the glue causes a relative locking parallel to the floor level.

The floor boards described above have several disadvantages. An important disadvantage is that once the floor has been installed it cannot be taken up without the floor boards being damaged. Thus, the floor boards cannot be reused once they have been taken up. Another disadvantage, caused by the tight fit between groove and tongue, is that it might be difficult to insert the tongues into the corresponding grooves, and that it may therefore be necessary to use tools to knock the floor boards into an interconnected position without any gap between the boards. This entails a considerable risk of the floor boards being damaged. A further disadvantage is that glue has to be used in the installation of the floor, which is not only difficult but also time-consuming.

In other prior-art floor boards, some of these disadvantages have been eliminated by dimensioning the grooves and tongues so that it is relatively easy to insert the tongues into the grooves. To interconnect these floor boards different kinds of clips are used, said clips being placed under two juxtaposed floor boards in such manner that they engage in grooves on the under-side of the floor boards by means of upwardly projecting protrusions. This solution allows an installed floor to be taken up in such manner that the floor boards may be reused. A disadvantage of the solution is, however, that loose parts in the form of clips need to be assembled during installation of the floor and that it implies a relatively difficult adjustment of the floor boards with regard to groove-tongue and clips-clip grooves.

SUMMARY OF THE INVENTION

The object of the present invention is to provide a floor board which is designed so as. to allow a floor to be installed in an extremely simple manner and without using loose parts or glue by means of a plurality of such similar floor boards and to make it possible to take up the floor boards and reuse them.

According to the invention, this object is achieved with a floor board of the type described by way of introduction, which is characterized in that the female coupling means in at least one, of said two pairs of coupling means comprises a first coupling element, which projects laterally from said one long side edge/short side edge and extends along this edge at a level below the upper surface of the floor board and which has an upwardly open groove extending along the first coupling element and an upper portion with a lower surface, which extends obliquely upwards and over the groove a short distance from the inner limiting wall thereof so as to form a stop, that the male coupling means in said one pair of coupling means comprises a second coupling element, which has substantially the shape of an upwardly open V and which extends along said other long side edge/short side edge in a longitudinal recess formed in the lower portion thereof, the outer V-leg of the second coupling element being springingly foldable in the direction of the inner V-leg of the second coupling element, and that the external V-shape of the second coupling element in its nondeformed state is substantially complementary to the shape of the groove of the first coupling element, the two coupling elements being located in such manner that, when interconnecting two similar floor boards, the groove in the first coupling element of one of the floor boards is situated directly under the substantially V-shaped second coupling element of the other floor board when the floor boards are in such a position relative to each other that their side edges facing each other are vertically aligned, and the two floor boards being inter-connectible by pressing the second coupling element of said other floor board down into the first coupling element of said one floor board, whereby the outer V-leg of the second coupling element is springingly folded, said V-leg springing back to its initial position and snapping in under said stop once the second coupling element has been inserted into the first coupling element.

The upper portion of the outer V-leg of the second coupling element projects laterally from said other long side edge/short side edge.

The female coupling means and the male coupling means preferably comprise a first and a second plastic section, respectively, having a flange which projects laterally from the first and the second coupling element, respectively, and which is mounted in a first and a second notch, respectively, formed at said one and said other long side edge/short side edge, respectively.

The flanges may be mounted in the respective notches by means of glue. The flange of both the first and the second plastic section is suitably provided with longitudinal, glue-receiving ducts that are substantially rectangular in cross section.

BRIEF DESCRIPTION OF THE DRAWINGS

The invention will now be described in more detail with reference to the accompanying drawings, in which.

DESCRIPTION OF A PREFERRED EMBODIMENT

Figure 1:
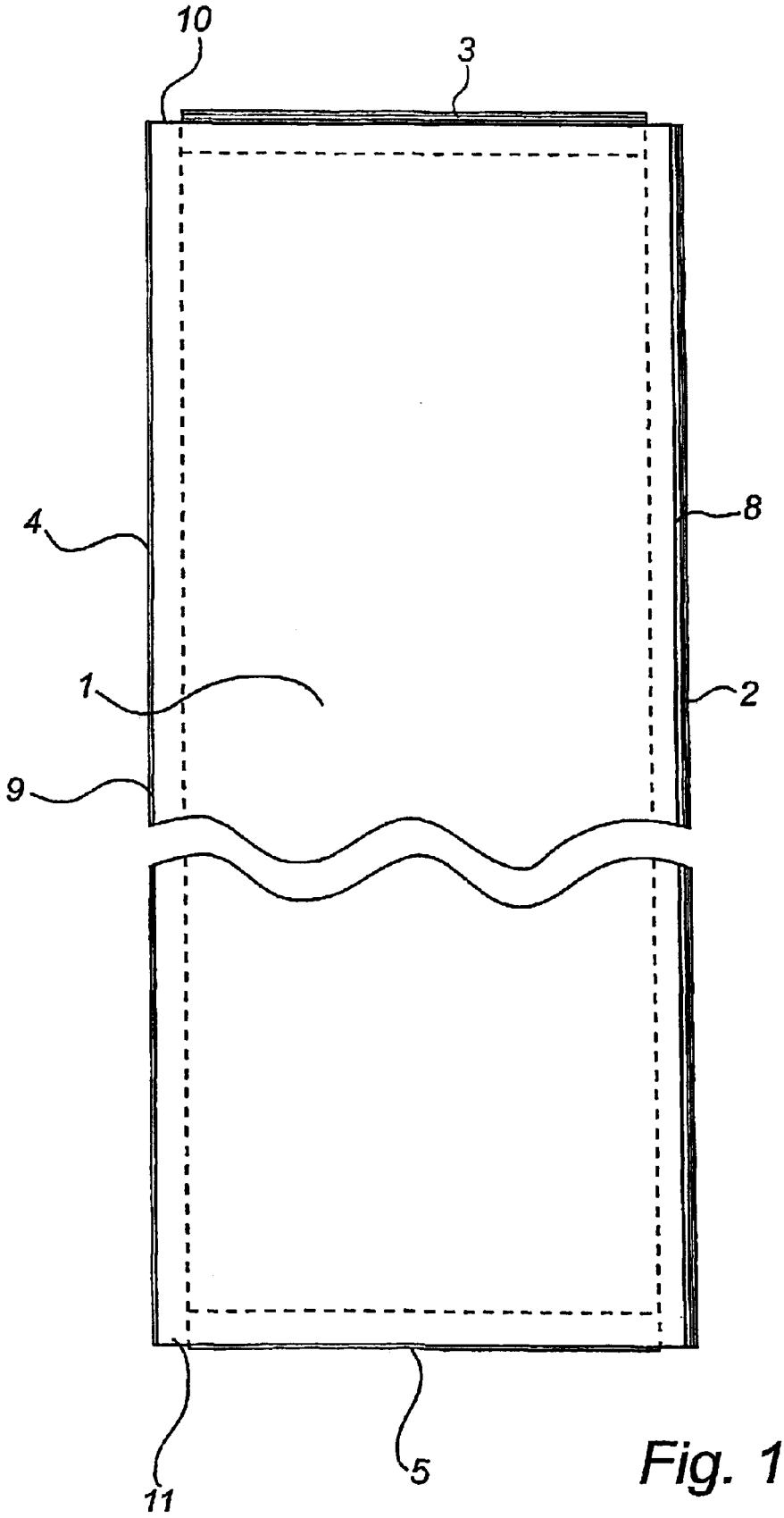
FIG. 1 illustrates a floor board according to the invention as seen from above.
Figure 2:
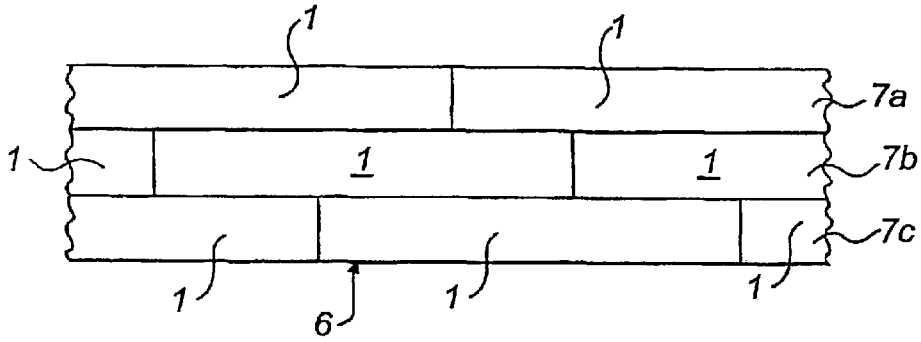
FIG. 2 is a plan view of a floor which is made up of a plurality of juxtaposed floor boards according to FIG. 1.

The floor board shown in FIG. 1 has a conventional, elongated rectangular shape. Floor boards of this type usually have a length of about 1200 mm and a width of about 190 mm. The floor board 1 has at its four side edges coupling means 2, 3, 4, 5 which are arranged to interact with the corresponding coupling means on other similar floor boards 1 during installation of a floor 6 (FIG. 2), so as to interconnect the floor boards. As shown in FIG. 2, the floor is made up of a plurality of adjacent, parallel rows 7*a*, 7*b*, 7*c* of juxtaposed floor boards 1, the floor boards 1 of one and the same row 7*a*, 7*b*, 7*c* being interconnected short side to short side and the floor boards 1 of adjacent rows 7*a*, 7*b*, 7*c* being interconnected long side to long side.

The coupling means 2–5 are composed of a first pair of coupling means 2, 4 consisting of a female coupling means 2, which extends along one long side edge 8 of the floor board 1, and a male coupling means 4, which extends along the other long side edge 9 of the floor board 1, and of a second pair of coupling means 3, 5 consisting of a female coupling means 3, which extends along one short side edge 10 of the floor board 1, and a male coupling means 5, which extends along the other short side edge 11 of the floor board 1.

The female coupling means 2, 3 in each pair of coupling means 2, 4 and 3, 5 consists of a section made of a plastic material. This plastic section has a first coupling element 12 and a flange 13, which projects laterally from said element and which is mounted by means of glue in a horizontal notch 14 formed at the side edge 8, 10. In its upper side and underside, the flange 13 is provided with longitudinal ducts 15 that are substantially rectangular in cross-section.

When attaching the female coupling means 2, 3 to the floor board 1, which is done in the factory during manufacture of the floor board, glue is applied to the flange 13, which is then inserted into the notch 14. When the glue has set, it adheres well to the upper and lower limiting walls of the notch 14 since the core of the floor board 1 in which the notch 14 has been formed, in the embodiment shown and as is usually the case, is made of a fibreboard or the like. The glue does not adhere as well to the plastic material of the flange 13, however, but this is compensated for by the fact that the glue, once set, fills the ducts 15 in the flange and thereby prevents the female coupling means 2, 3 from being extracted.

The notch 14 has a widened portion 17 at its mouth, said portion receiving part of the first coupling element 12. The widened portion 17 extends downwards to the underside of the floor board 1, but is terminated a short distance from its upper side.

The first coupling means 12 is located below the upper side of the floor board 1 and comprises a vertical, inwardly facing side 18, which abuts against the shoulder 19 formed by the transition between the main part of the notch 14 and its widened portion 17. Recesses 16 for collecting any excess glue during insertion of the flange 13 of the female coupling means 2, 3 into the notch 14 are formed at the side 18. The first coupling means 12 further comprises a horizontal underside 20, which is located on a level with the underside of the floor board 1, and an outwardly facing side 21, which extends steeply (about 80 degrees) obliquely upwards-outwards. An up-wardly open groove 22 is formed in the first coupling element 12. The first coupling element 12 also has an upper portion 23 with a lower surface 24, which extends about 45 degrees obliquely upwards a short distance over the groove 22 from the inner limiting wall 25 thereof to form a stop. The outer edge of the upper portion 23 is located in line with the edge 8, 10 of the floor board 1. The outer limiting wall 26 of the groove 22 is substantially parallel to the outwardly facing side 21 of the first coupling element 12.

The male coupling means 4, 5 in each pair of coupling means 2, 4 and 3, 5 comprises a section made of a plastic material. The plastic section has a second coupling element 27, a laterally projecting flange 28, which is mounted by means of glue in a horizontal notch 29 formed at the side edge 9, 11, and a connecting portion 30 connecting the second coupling element 27 and the flange 28. In its upper side and underside, the flange 28 is provided with longitudinal ducts 31 that are substantially rectangular in cross-section.

When attaching the male coupling means 4, 5 to the floor board 1, which is also done in the factory during manufacture of the floor board, glue is applied to the flange 28, which is then inserted into the notch 29. When the glue has set, it adheres well to the upper and lower limiting walls of the notch 29 since the core of the floor board 1 in which the notch 29 has been formed here is made, as mentioned above, of a fibreboard or the like. The glue does not adhere as well to the plastic material of the flange 28, however, but this is compensated for by the fact that the glue, once set, fills the ducts 31 in the flange and thereby prevents the male coupling means 4, 5 from being extracted.

The notch 29 has a widened portion 33 at its opening, said portion receiving the connecting portion 30 and the main part of the second coupling element 27. The widened portion 33 extends downwards to the underside of the floor board 1, but is terminated a short distance from its upper side.

The connecting portion 30 has substantially the shape of an inverted L, its vertical leg 34 abutting against the shoulder 35 formed by the transition between the main part of the notch 29 and its widened portion 33, and its horizontal leg 36 abutting against the upper limiting wall of the widened portion 33. The vertical leg 34 of the connecting portion 30 is connected to the flange 28 and extends downwards to the level of the underside of the floor board 1, and its horizontal leg 36 is connected at its free end to the second coupling means 27. Recesses 32 for collecting any excess glue during insertion of the flange 28 of the male coupling means 4, 5 into the notch 29 are formed at the side of the vertical leg 34 that abuts against the floor board 1.

The second coupling means 27 has substantially the shape of an upwardly open V, the inner V-leg 37 of which is connected to the connecting portion 30. The upper portion of the outer V-leg 38 projects laterally a short distance beyond the long side edge/short side edge 9, 11 of the floor board 1.

Figure 5:
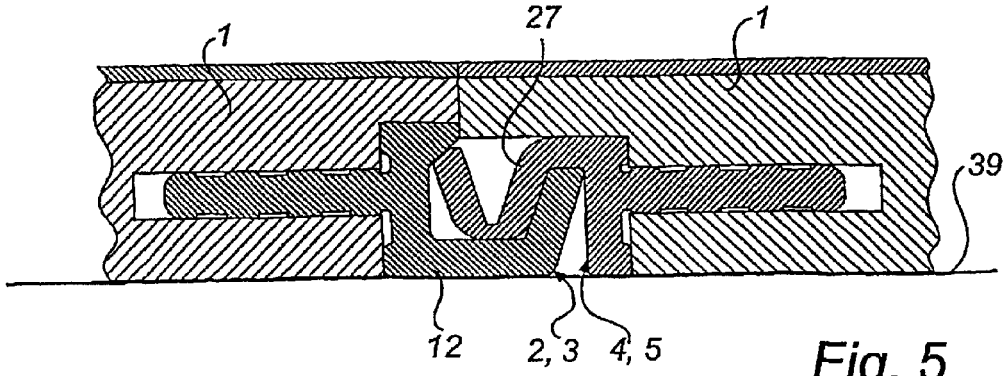

The outer V-leg 38 is springingly foldable in the direction of the inner V-leg 37 to such an extent that its upper portion can be inserted to a position within the side edge 9, 11. The external V-shape of the second coupling element 27 is, in its nondeformed state, i.e. the state shown in FIGS. 3 and 5, substantially complementary to the shape of the groove 22 of the first coupling element 12. In this context (see FIG. 5), "complementary" means that the inner V-leg 37 of the second coupling element 27 is inclined at the same angle as the outer limiting wall 26 of the groove 22 and that, when a male coupling means 4, 5 of a floor board 1 engages a female coupling means 2, 3 of another floor board 1, the outer V-leg 38 of the second coupling element 27 of said male coupling means abuts, in its nondeformed state, against the stop surface 24 of the first coupling element 12 of said female coupling means while the second coupling element 27 rests against the bottom of the groove 22 and its inner V-leg 37 abuts against the outer limiting wall 26 of the groove 22.

Figure 3:
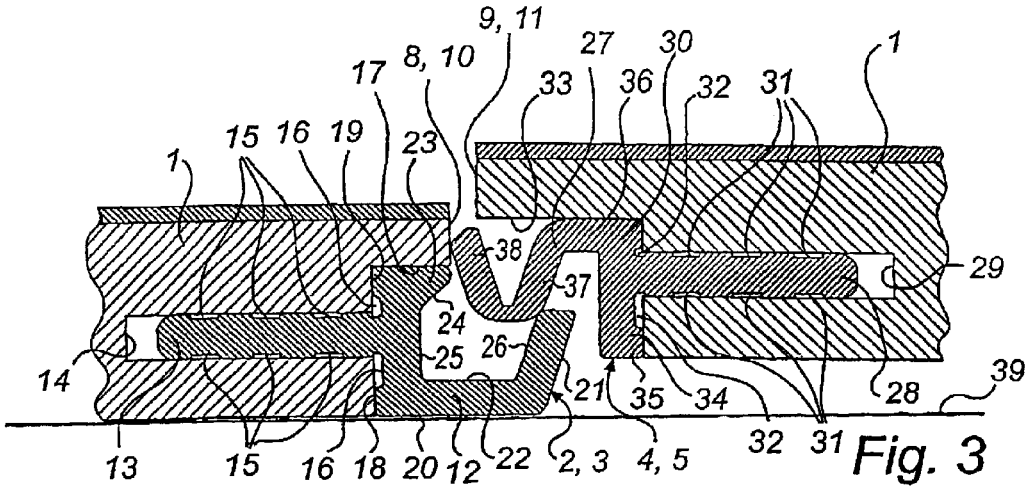
FIGS. 3–5 illustrate the interconnection of two floor boards according to FIG. 1.

When installing a floor 6 on a support surface 39 by means of floor boards 1 according to the present invention, a first floor board 1 is arranged substantially horizontally in such manner relative to an already installed second floor board 1 that the second coupling element 27 in one of its male coupling means 4, 5 is located substantially directly above the first coupling element 12 in the corresponding female coupling means 2, 3 of the installed second floor board 1 (see FIG. 3). In this position, the projecting upper portion of the outer V-leg 38 rests against the long side edge/short side edge 8, 10 of the installed second floor board 1 and the lower portion of the inner V-leg 37 rests against the outer limiting wall 26 of the groove 22 in the first coupling element 12.

Figure 4:
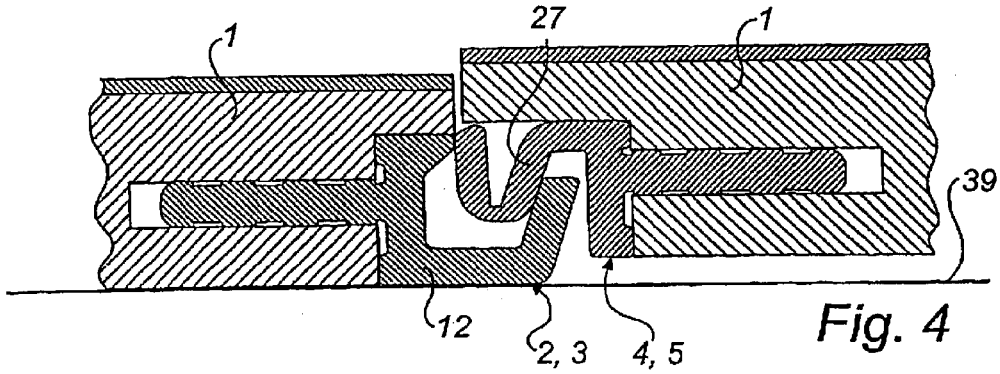

From this position, the first floor board 1 is pressed downwards towards the support surface 39. The first floor board 1 is thus moved by slidingly displacing the inner V-leg 37 of the second coupling element 27 on the outer limiting wall 26 of the groove 22 closer to the installed second floor board 1 while the outer V-leg 38 of the second coupling element 27 is springingly folded in the direction of the inner V-leg 37 (see FIG. 4). Once the V-shaped second coupling element 27 has been completely inserted into the groove 22 of the first coupling element 12, its outer V-leg 38 will spring back to its original nondeformed state and snap in under the stop surface 24. In this connected state (See FIG. 5), the two floor boards 1 are on a level with each other and abut against each other side edge 8, 10 to side edge 9, 11 without any play.

Figure 6:
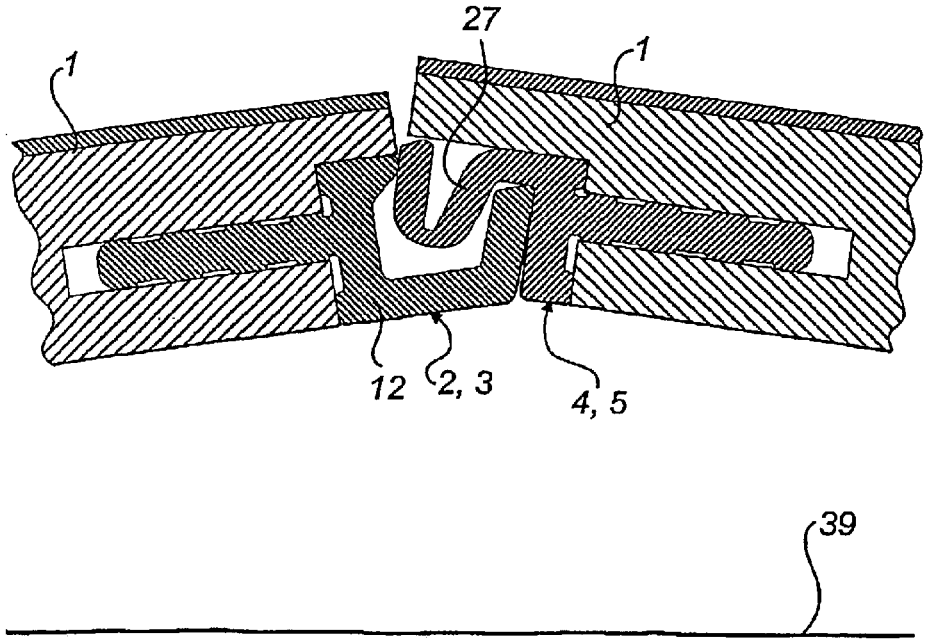
FIG. 6 illustrates how two floor boards that have been interconnected can be separated.

If, for some reason, the floor 6 is to be taken up, the first floor board 1 is lifted slightly from the surface 39 in the way shown in FIG. 6 by means of a suitable tool, for example a crowbar, which results in the adjacent floor boards 1 being inclined relative to one another. This inclination is made possible by the fact that, in the connected state, there is a wedge-shaped, free space 40 between the outwardly facing side 21 of the first coupling element 12 and the vertical L-leg 34 of the connecting portion 30 and a wedge-shaped, free space 41 between the inner limiting wall 25 of the groove 22 and the outer V-leg 38 of the second coupling element 27. From this elevated position, the floor board 1 provided with the female coupling means 2, 3 is pressed downwards towards the support surface while the floor board 1 provided with the male coupling means 4, 5 is retained in the elevated position. The floor boards 1 are thus disengaged from each other without breaking, which allows them to be reused.

The floor board 1 described above may be modified in various ways within the scope of the invention. Thus, the plastic sections forming the coupling means 2–5 may, for example, be replaced by coupling means that are milled directly in the floor board, when the latter is made of a composite material with a certain resiliency which consists of compressed plastic and wood powder.

What is claimed is:

1. A floor board of elongated rectangular shape, which comprises a plurality of couplers at its side edges and arranged to be connected to other similar floor boards to form a floor that is made up of a plurality of adjacent, parallel rows of juxtaposed floor boards and in which the floor boards of one and the same row are interconnected short side to short side and the floor boards of adjacent rows are interconnected long side to long side, the plurality of couplers having a first pair of couplers comprising a first female coupler and a first male coupler extending along first and second long side edges of the floor board, respectively, and a second pair of couplers comprising a second female coupler and a second male coupler extending along first and second short sides of the floor board, respectively, wherein the first and second female couplers in at least one of the two pairs of couplers comprise a first coupling element that projects laterally from a first long side edge/short side edge and extends along this edge at a level below the upper surface of the floor board and having an upwardly open groove extending along the first coupling element and an upper portion with a lower surface that extends obliquely upwards and over the groove a short distance from the inner limiting wall thereof so as to form a stop, and wherein the first and second male couplers in at least one of the two pair of couplers comprises a second coupling element that has substantially the shape of an upwardly open V and extends along a second long side edge/short side edge in a longitudinal recess formed in the lower portion thereof, the outer V-leg of the second coupling element being springingly foldable in the direction of the inner V-leg of the second coupling element, and wherein the external V-shape of the second coupling element in its nondeformed state is substantially complementary to the shape of the groove of the first coupling element, and wherein the first and second coupling elements being located in such manner that, when interconnecting two similar floor boards, the groove in the first coupling element of one of the floor boards is situated directly under the substantially V-shaped second coupling element of the other floor board when the floor boards are in such a position relative to each other that their side edges facing each other are vertically aligned, and further wherein two floor boards are interconnectible by pressing the second coupling element of the other floor board down into the first coupling element of the one floor board, whereby the outer V-leg of the second coupling element is springingly folded, the V-leg springing back to its initial position and snapping in under the stop once the second coupling element has been inserted into the first coupling element.

2. A floor board according to claim 1, wherein the upper portion of the outer V-leg of the second coupling element projects laterally from the second long side edge/short side edge.

3. A floor board according to claim 1, wherein the first and second female couplers comprise a first plastic section having a flange that projects laterally from the first coupling element and is mounted in a first notch formed at the first long side edge/short side edge.

4. A floor board according to claim 3, wherein the flange of the first plastic section is mounted in the first notch by glue.

5. A floor board according to claim 4, wherein the flange of the first plastic section is provided with longitudinal, glue-receiving ducts that are substantially rectangular in cross-section.

6. A floor board according to claim 1, wherein the first and second male couplers further comprise a second plastic section having a flange that projects laterally from the second coupling element and is mounted in a second notch formed at the second long side edge/short side edge.

7. A floor board according to claim 6, wherein the flange of the second plastic section is mounted in the second notch by glue.

8. A floor board according to claim 7, wherein the flange of the second plastic section is provided with longitudinal, glue-receiving ducts that are substantially rectangular in cross-section.

9. A floor board system comprising:

a floor board arranged to be connectable to other boards to form a floor;

a first female coupler extending along a first edge of the board, wherein the first female coupler comprises a first coupling element having a groove and a surface extending obliquely from the groove and away from a wall of the groove so as to form a stop; and a first male coupler extending along a second edge of the board, wherein the first male coupler comprises a second coupling element having a V shape portion and a portion disposed in a recess formed in the board, wherein an outer V-leg of the second coupling element is deformable in the direction of an inner V-leg, and wherein the second coupling element in its non-deformed state is complementary to the shape of the groove of the first coupling element, wherein the groove in a first board and the V-shaped portion of a second board are interconnectible when the edges of the first and second boards are vertically aligned, and wherein the two boards are interconnected by disposing the second coupling element into the first coupling element, whereby the outer V-leg is deformed, the V-leg deforming back to its initial position and fitting in under the stop once the second coupling element has been disposed into the first coupling element.

* * * * *